United States Patent [19]

Brownawell et al.

[11] Patent Number: 5,068,044

[45] Date of Patent: Nov. 26, 1991

[54] METHOD FOR REDUCING PISTON DEPOSITS

[75] Inventors: Darrell W. Brownawell, Scotch Plains; Warren A. Thaler, Flemington; Eric Bannister, Colts Neck; Paul K. Ladwig, Randolph, all of N.J.

[73] Assignee: Exxon Research & Engineering Company, Florham Park, N.J.

[21] Appl. No.: 488,194

[22] Filed: Mar. 5, 1990

Related U.S. Application Data

[63] Continuation of Ser. No. 269,274, Nov. 9, 1988, Pat. No. 4,906,389.

[51] Int. Cl.[5] ..... C10M 129/28

[52] U.S. Cl. ..... 252/25; 208/182; 208/50; 252/49.8

[58] Field of Search ..... 252/25, 49.8, 50; 208/182

[56] References Cited

U.S. PATENT DOCUMENTS

| | | | |
|---|---|---|---|
| 2,093,430 | 9/1937 | Franklin et al. | 208/182 |
| 2,251,988 | 8/1941 | Curran | 252/11 |
| 2,343,427 | 3/1944 | Wells | 208/182 |
| 2,366,190 | 1/1945 | Hurn | 208/182 |
| 2,445,901 | 7/1948 | Ambrose | 252/11 |
| 4,326,953 | 4/1982 | Gibby et al. | 208/182 |

*Primary Examiner*—Jacqueline V. Howard
*Attorney, Agent, or Firm*—John W. Ditsler

[57] ABSTRACT

Piston deposits resulting from neutralizing combustion acids present in the lubricating oil circulating within the lubrication system of an internal combustion engine are reduced or eliminated by first contacting the acids with a soluble weak base in the piston ring zone of the engine to form soluble neutral salts containing the weak base and the combustion acids. Thereafter, the neutral salts are contacted with a heterogeneous strong base immobilized within the lubrication system but outside of the piston ring zone. The strong base displaces the weak base from the neutral salts, returning the weak base to the oil for recirculation to the piston ring zone for further use. The remaining strong base/combustion acid salts are immobilized as deposits with the strong base rather than on the piston. In a preferred embodiment, trioctadecyl amine is the weak base and zinc oxide is the strong base. In a particularly preferred embodiment, the strong base is incorporated on a substrate, preferably a cement binder.

35 Claims, 4 Drawing Sheets

METHOD FOR REDUCING PISTON DEPOSITSp

This is a continuation of application Ser. No. 269,274 filed 11/9/88, now U.S. Pat. No. 4,906.

BACKGROUND OF THE INVENTION

1. Field of the Invention

The present invention relates to a method for reducing piston deposits in an internal combustion engine by using a soluble ashless detergent and a heterogenous strong base immobilized within the lubricating system of the engine.

2. Discussion of Related Art

The optimum functioning of an internal combustion engine (especially a diesel engine) requires that fuel combustion acids (e.g., carboxylic, nitric, nitrous, sulfuric and sulfurous acids —with or without alkyl groups) be neutralized where they first contact the lubricant, i.e., at the piston. In the absence of this acid neutralization, the lubricant gels, its viscosity rapidly increases, and engine deposits are formed. This results in increased oil consumption and engine wear.

Traditionally metal-containing (i.e. ash-containing) detergents (e.g., barium, calcium, or magnesium overbased sulfonates or phenates) have been used to neutralize combustion acids (See, for example, U.S. Pat. Nos. 2,316,080; 2,617,049; 2,647,889; and 2,835,688). In the absence of metal detergents, as for example in ashless oils, polyethyleneamine based dispersants have been used for neutralization (See, for example, U.S. Pat. No. 3,172,892, the disclosure of which is incorporated herein by reference). However, ashless detergents are generally not used in lubricating oils because polyethyleneamines are less cost effective than ash-containing detergents and normally do not maintain adequate TBN (Total Base Number).

Well formulated lubricants containing metal detergents are very effective in reducing piston deposits. Often, however, a limit is reached where it becomes increasingly more difficult to further reduce piston deposits. As this limit is approached, an appreciable percentage of piston deposits results from the metal component of the detergents. For example, the deposits on some pistons contain up to 34 wt.% calcium and magnesium. (See A. Sohetelich et al., "The Control of Piston Crown Land Deposits in Diesel Engines Through Oil Formulation," Soc. Automat. Eng. Tech., Pub. Ser. 861517 (1986)). Therefore, it would be desirable to have available a simple and convenient, yet cost effective, method for reducing piston deposits in an internal combustion engine and, preferably, for transferring or moving the deposits to a part of the engine's lubrication system where they will not impair engine performance.

SUMMARY OF THE INVENTION

This invention relates to a method for reducing piston deposits resulting from the neutralization of fuel combustion acids in the piston ring zone (i.e., that area of the piston liner traversed by the reciprocating piston) of an internal combustion engine. More specifically, these deposits can be reduced or eliminated from the engine by contacting the combustion acids at the piston ring zone with a soluble weak base for a period of time sufficient to neutralize a major portion (preferably essentially all) of the combustion acids and form soluble neutral salts which contain a weak base and a strong combustion acid. These soluble neutral salts then pass (or circulate) with the lubricating oil from the piston ring zone to a heterogenous strong base immobilized within the lubrication system of the engine. By "heterogenous strong base" is meant that the strong base is in a separate phase (or substantially in a separate phase) from the lubricating oil, i.e., the strong base is insoluble or substantially insoluble in the oil. When the neutral salts contact the strong base, the strong base displaces the weak base and releases it into the oil for recirculation to (and reuse in) the piston ring zone. The strong combustion acid/strong base salts formed from reacting the neutral salts with the strong base are immobilized as deposits on the heterogenous strong base and are, thus, removed from the oil, but at a location other than the piston ring zone. Preferably, the weak base is a trialkyl amine (e.g., trioctadecyl amine) and the strong base is zinc oxide. Most preferably the strong base will be incorporated on or with a substrate immobilized within the lubrication system, but outside of the piston ring zone.

Other embodiments of this invention include (1) a method for selectively transferring deposits (especially piston deposits) from one location in the lubrication system of an internal combustion engine to another location in the lubrication system by specifying the acid/base chemistry at each location and (2) a system for reducing deposits (especially piston deposits) in an internal combustion engine that utilizes a lubricating oil, a soluble weak base, and a heterogenous strong base to neutralize combustion acids and prevent the deposits from forming.

DETAILED DESCRIPTION OF THE INVENTION

Figure 1:
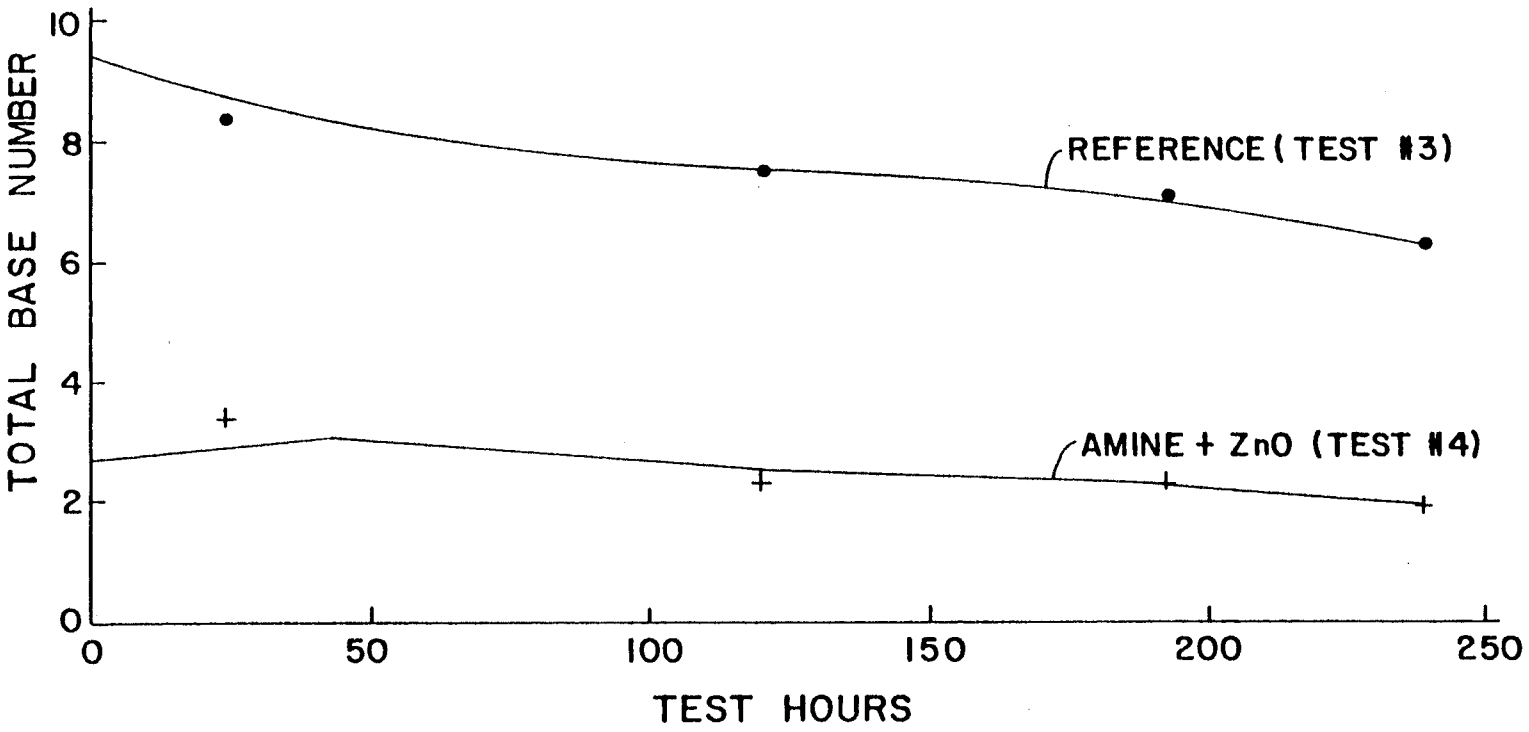
FIG. 1 shows the change in Total Base Number with time for two lubricating oil blends

The lubricating (or crankcase) oil circulating within the lubrication system of an internal combustion engine will comprise a major amount of a lubricating oil basestock (or base oil) and a minor amount of one or more additives. The lubricating oil basestock can be derived from natural lubricating oils, synthetic lubricating oils, or mixtures thereof. In general, the lubricating oil basestock will have a viscosity in the range of about 5 to about 10,000 cSt at 40° C., although typical applications will require an oil having a viscosity ranging from about 10 to about 1,000 cSt at 40° C.

Natural lubricating oils include animal, vegetable (e.g., castor oil and lard oil), petroleum, or mineral oils.

Synthetic lubricating oils include alkylene oxide polymers, interpolymers, and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of poly-propylene glycol having a molecular weight of 1000–1500); and mono- and polycarboxylic esters thereof (for example, the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyakyl-, polyaryl, polyalkoxy-, or polyaryloxysiloxane oils and silicate oils comprise another useful class of synthetic lubricating oils; they include tetraethyl silicate, tetraisopropyl silicate, tetra-(2-ethylhexyl) silicate, tetra-(4-methyl-2-ethylhexyl) silicate, tetra(p=tert-butylphenyl) silicate, hexa-(4-methyl-2pentoxy) disiloxane, poly(methyl) siloxanes and poly(methyl-phenyl) siloxanes. Other synthetic lubricating oils include liquid esters of phosphorus-containing acids (e.g., tricresyl phosphate, trioctyl phosphate, diethyl ester of decylphosphonic acid); polymeric tetrahydrofurans, and polyalphaolefins.

The lubricating oil used may be derived from unrefined, refined, and rerefined oils. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydro-treating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating oil will contain a weak base, which will normally be added to the lubricating oil during its formulation or manufacture. Broadly speaking, the weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof. Examples of basic organonitrogen compounds include, but are not limited to, pyridines; anilines; piperazines; morpholines; alkyl, dialkyl, and trialky amines; alkyl polyamines; and alkyl and aryl guanidines. Alkyl, dialkyl, and trialkyl phosphines are examples of basic organophosphorus compounds.

Examples of particularly effective weak bases are the dialkyl amines ($R_2HN$), trialkyl amines ($R_3N$), dialkyl phosphines ($R_2HP$), and trialkyl phosphines ($R_3P$) is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri- alkyl phosphines and the di- and tri-alkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinic anhydride with more than 40 carbons in the polybutenyl group.

The weak base must be strong enough to neutralize the combustion acids (i.e., form a salt). Suitable weak bases will typically have a PKa from about 4 to about 12. However, even strong organic bases (such as organoguanidines) can be utilized as the weak base if the strong base is an appropriate oxide or hydroxide and is capable of releasing the weak base from the weak base/-combustion acid salt.

The molecular weight of the weak base should be such that the protonated nitrogen compound retains its oil solubility. Thus, the weak base should have sufficient solubility so that the salt formed remains soluble in the oil and does not precipitate. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize at least a portion of the combustion acids present at the piston ring zone. Typically, the amount will range from about 0.01 to about 3 wt.% or more, preferably from about 0.1 to about 1.0 wt.%.

Following neutralization of the combustion acids, the neutral salts are passed or circulated from the piston ring zone with the lubricating oil and contacted with a heterogenous strong base. By strong base is meant a base that will displace the weak base from the neutral salts and return the weak base to the oil for recirculation to the piston ring zone where the weak base is reused to neutralize combustion acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide ($Mg(OH)_2$), magnesium oxide (MgO), sodium aluminate ($NaAlO_2$), sodium carbonate ($Na_2CO_3$), sodium hydroxide (NaOH), zinc oxide (ZnO), or their mixtures, with ZnO being particularly preferred.

The strong base may be incorporated (e.g. impregnated) on or with a substrate immobilized in the lubricating system of the engine, but subsequent to (or downstream of) the piston ring zone. Thus, the substrate can be located on the engine block or near the sump. Preferably, the substrate will be part of the filter system for filtering oil, although it could be separate therefrom. Suitable substrates include, but are not limited to, alumina, activated clay, cellulose, cement binder, silica-alumina, and activated carbon. The alumina, cement binder, and activated carbon are preferred, with cement binder being particularly preferred. The substrate may be inert or not inert.

The strong base may be incorporated on or with the substrate by methods known to those skilled in the art. For example, if the substrate were alumina, the strong base can be deposited by using the following technique. A highly porous alumina is selected. The porosity of the alumina is determined by weighing dried alumina and then immersing it in water. The alumina is removed from the water and the surface water removed by blowing with dry air. The alumina is then reweighed and compared to the dry alumina weight The difference in weight is expressed as grams of water per gram of dry alumina. A saturated solution of calcium oxide in water is prepared. This solution is then added to the dry alumina in an amount equal to the difference between the weight of wet and dry alumina. The water is removed from the alumina with heat leaving CaO deposited on the alumina as the product. This preparation can be carried out at and ambient conditions, except the water removal step is performed above 100° C.

The amount of strong base required will vary with the amount of weak base in the oil and the amount of combustion acids formed during engine operation. However, since the strong base is not being continuously regenerated for reuse as is the weak base (i.e., the alkyl amine), the amount of strong base must be at least equal to (and preferably be a multiple of) the equivalent weight of the weak base in the oil. Therefore, the amount of strong base should be from 1 to about 15 times, preferably from 1 to about 5 times, the equivalent weight of the weak base in the oil.

Once the weak base has been displaced from the soluble neutral salts, the strong base/strong combustion acid salts thus formed will be immobilized as heterogenous deposits with the strong base or with the strong base on a substrate if one is used. Thus, deposits which would normally be formed in the piston ring zone are not formed until the soluble salts contact the strong base. Preferably, the strong base will be located such that it can be easily removed from the lubrication system (e.g., included as part of the oil filter system).

In addition to the weak base, other additives known in the art may be added to the lubricating base oil to form a fully formulated lubricating oil. Such lubricating oil additives include dispersants, antiwear agents, antioxidants, corrosion inhibitors, other detergents, pour point depressants, extreme pressure additives, viscosity index improvers, friction modifiers, and the like. These additives are typically disclosed, for example, in "Lubricant Additives" by C.V. Smalheer and R. Kennedy Smith, 1967, pp. 1–11 and in U.S. Pat. No. 4,105,571, the disclosures of which are incorporated herein by reference. Normally, there is from about 2 to about 20 wt.% of these additives in a fully formulated engine lubricating oil.

Although this invention has been described heretofore with respect to reducing or eliminating piston zone deposits, the invention may be more broadly applied to reducing or eliminating deposits resulting from neutralizing essentially any acids present in the lubricating oil circulating within the lubrication system of essentially any internal combustion engine including gasoline, diesel, rotary, heavy feed, gas-fired, and methanol powered engines. This invention also does not contribute to particulate emissions in these applications because the need for ash-containing additives in the oil is reduced or eliminated.

In another embodiment, this invention is a method for causing (or transferring) deposits resulting from neutralizing acids present in the lubricating oil of an internal combustion engine (especially piston deposits), which deposits would normally form at one location in the lubrication system of the engine (e.g., the piston), to form in (or be transferred to) another location within the lubrication system (e.g., in the oil filter) by specifying the acid/base chemistry at each location. In this embodiment, a weak base is first added to the lubricating oil circulating within the lubrication system. The weak base reacts with the acids present in the lubricating oil circulating within the system to form a neutral salt of the weak base and the acids. The weak base must contain a sufficient number of carbon atoms to ensure that the neutral salt formed from the acid neutralization is soluble in the oil so that deposits are prevented from forming at the point of acid/base contact. The neutral salt then passes or circulates with the oil to another location within the lubrication system where the salt is contacted with a heterogenous strong base immobilized at this location. The strong base displaces the weak base from the soluble salt and releases the weak base into the oil, leaving behind a salt deposit containing the strong base and the acids. Thus, contact of the neutral salt with the strong base causes a deposit to form where the strong base is located. In this way, deposits resulting from acid neutralization are transferred from one location to another location in the lubrication system of an internal combustion engine.

In yet another embodiment, this invention is a system for reducing piston deposits in an internal combustion engine, said deposits resulting from neutralizing acids present in the lubricating oil of said engine, which comprises (a) a lubricating oil that circulates through the lubrication system of the engine, (b) a soluble weak base capable of neutralizing acids present in the oil to form soluble neutral salts containing the weak base and the acids, and (c) a heterogenous strong base immobilized within the lubrication system of the engine, the strong base being capable of displacing the weak base from the soluble neutral salts such that the weak base is returned to the lubricating oil and the resulting strong base/acid salt is deposited or immobilized with the heterogenous strong base.

When this embodiment is specific to reducing piston deposits, the acid neutralization of step (b) occurs at the piston ring zone of the engine and the heterogenous strong base in step (c) is immobilized outside or downstream of the piston ring zone.

Any of the foregoing embodiments of this invention can be combined with the removal of carcinogenic components from a lubricating oil. For example, polynuclear aromatic hydrocarbons (especially PNA's with at least three aromatic rings) that are usually present in used lubricating oil can be substantially removed (i.e., reduced by from about 60 to about 90% or more) by passing the oil through a sorbent located within the lubrication system through which the oil must circulate after being used to lubricate the engine. The sorbent may be immobilized with the substrate described above or immobilized separate therefrom. Preferably, the substrate and sorbent will be part of the engine filter system for filtering oil. The sorbent can be conveniently located on the engine block or near the sump, preferably downstream of the oil as it circulates through the engine; i.e., after the oil has been heated. Most preferably, the sorbent is downstream of the substrate.

Suitable sorbents include activated carbon, attapulgus clay, silica gel, molecular sieves, dolomite clay, alumina, zeolite, or mixtures thereof. Activated carbon is preferred because (1) it is at least partially selective to the removal of polynuclear aromatics containing more than 3 aromatic rings, (2) the PNA's removed are tightly bound to the carbon and will not be leached-out to become free PNA's after disposal, (3) the PNA's removed will not be redissolved in the used lubricating oil, and (4) heavy metals such as lead and chromium will be removed as well. Although most activated carbons will remove PNA's to some extent, wood and peat based carbons are significantly more effective in removing three and four ring aromatics than coal or coconut based carbons.

The amount of sorbent required will depend upon the PNA concentration in the lubricating oil. Typically, for a five quart oil change, about 20 to 150 grams of activated carbon can reduce the PNA content of the use lubricating oil by up to 90%. Used lubricating oils usually contain from about 10 to about 10,000 wppm of PNA's.

It may be necessary to provide a container to hold the sorbent, such as a circular mass of sorbent supported on wire gauze. Alternatively, an oil filter could comprise the sorbent capable of combining with polynuclear aromatic hydrocarbons held in pockets of filter paper. These features would also be applicable to the substrate.

Any of the foregoing embodiments of this invention can also be combined with a sorbent (such as those described above) that is mixed, coated, or impregnated with additives normally present in engine lubricating oils. In this embodiment, additives (such as the lubricating oil additives described above) are slowly released into the lubricating oil to replenish the additives as they are depleted during operation of the engine. The ease with which the additives are released into the oil depends upon the nature of the additive and the sorbent. Preferably, however, the additives will be totally released within 150 hours of engine operation. In addition, the sorbent may contain from about 50 to about 100 wt.% of the additive (based on the weight of activated carbon), which generally corresponds to 0.5 to 1.0 wt.% of the additive in the lubricating oil.

Thus, the various embodiments of this invention can be combined to remove PNA's from a lubricating oil, to extend the useful life of a lubricating oil by releasing conventional additives into the oil, or both.

The present invention may be further understood by reference to the following examples which are not intended to restrict the scope of the claims appended hereto.

EXAMPLE 1

Six EMA SCOTE engine tests were performed on four different oil formulations using a fuel containing 0.4 wt.% sulfur. An EMA SCOTE test uses a 1Y540 engine that is operated according to the 1-J test procedure developed by the PC-1 committee of A.S.T.M. The essential hardware components of this test include a 1Y704 piston, 1Y702 liner, and 1Y635/1W9460 rings. The engine is operated at 2100 rpm and 70 BHP.

Tests 1 and 2 were run in different engine test stands and at different times than tests 3–6, which were run sequentially in the same test stand. All tests were performed under the same engine test conditions.

Tests 1–3 used a fully formulated 15W/40 premium lubricating oil containing a total of 3.5 wt.% calcium and magnesium phenate detergents. This oil served as a reference oil. For tests 4–6, the phenate detergents were removed from the reference oil and replaced by 0.5 wt.% trioctadecyl amine in the oil, or by zinc oxide pellets (available from Katalco as catalyst 75 1) in the oil filter, or by both. The results obtained from these tests are summarized in Table 1.

TABLE 1

| | | | | Reference Oil w/o Metal Detergents But With | | |
|---|---|---|---|---|---|---|
| Oil | Reference Oil | | | Amine + ZnO | Amine | ZnO |
| Test No. | 1 | 2 | 3 | 4 | 5 | 6 |
| % TGF (1) | 33 | 26 | 31 | 9 | 42 | 7 |
| WTD (2) | | | | | | |
| 1G2 (3) | 1308 | 1286 | 1051 | 1239 | 1660 | 1293 |
| WD5 (4) | (5) | (5) | 414 | 895 | 1782 | 3158 |

(1) Percent Top Groove Fill is a measure of piston cleanliness.
(2) Weighted Total Demerits is a measure of piston cleanliness.
(3) The % TGF and 1G2 methods of calculating WTD are the current methods of evaluating the SCOTE piston.
(4) The WD5 is a proposed method for calculating WTD that gives greater weight to deposits lower on the piston; e.g., on the upper skirt, pin bases, and undercrown.
(5) Not calculated because the pistons were not rated for the appropriate parts of the piston used in the WD5 rating procedure.

(3) The % TGF and 1G2 methods of calculating WTD are the current methods of evaluating the SCOTE piston. (4) The WD5 is a proposed method for calculating WTD that gives greater weight to deposits lower on the piston; e.g., on the upper skirt, pin bases, and undercrown. (5) Not calculated because the pistons were not rated for the appropriate parts of the piston used in the WD5 rating procedure.

The data in Table 1 show that replacing 3.5 wt. % metal detergent in the oil (Test Nos. 1–3) with 0.5 wt. % ashless amine in the oil plus ZnO pellets in the. filter (Test No. 4) markedly improved TGF while maintaining overall piston cleanliness as measured by 1G2. When ZnO pellets were present in the filter with or without trioctadecyl amine in the oil (Test Nos. 4 and 6), the top of the piston as measured by TGF and the 1G2 method of calculating WTD was relatively clean. However, when the amine was not present (Test No. 6), the bottom of the piston (especially the upper skirt, pin bore and undercrown which are part of the WD5 method of calculating WTD) was very dirty. When ZnO is not present (Test No. 5), the top of the piston is dirty as shown by the 42% TGF. Thus, both the weak base (the amine) and the strong base (the ZnO) are necessary for control of piston cleanliness.

In addition to keeping the piston clean, a lubricant must control the loss in oil basicity (i.e., TBN), the gain in acidity (i.e., TAN), engine wear as measured by ppm Fe in the oil, and the formation of insoluble species in the oil as measured by pentane insolubles. The changes in these factors for certain of the oils tested are shown in FIGS. 1-4.

FIG. 1 illustrates that the lubricating oil containing the amine with ZnO in the filter (Test No. 4) had less loss of TBN (as measured by ASTM 2896) than the reference oil containing the metal detergents (Test No. 3).

Figure 2:
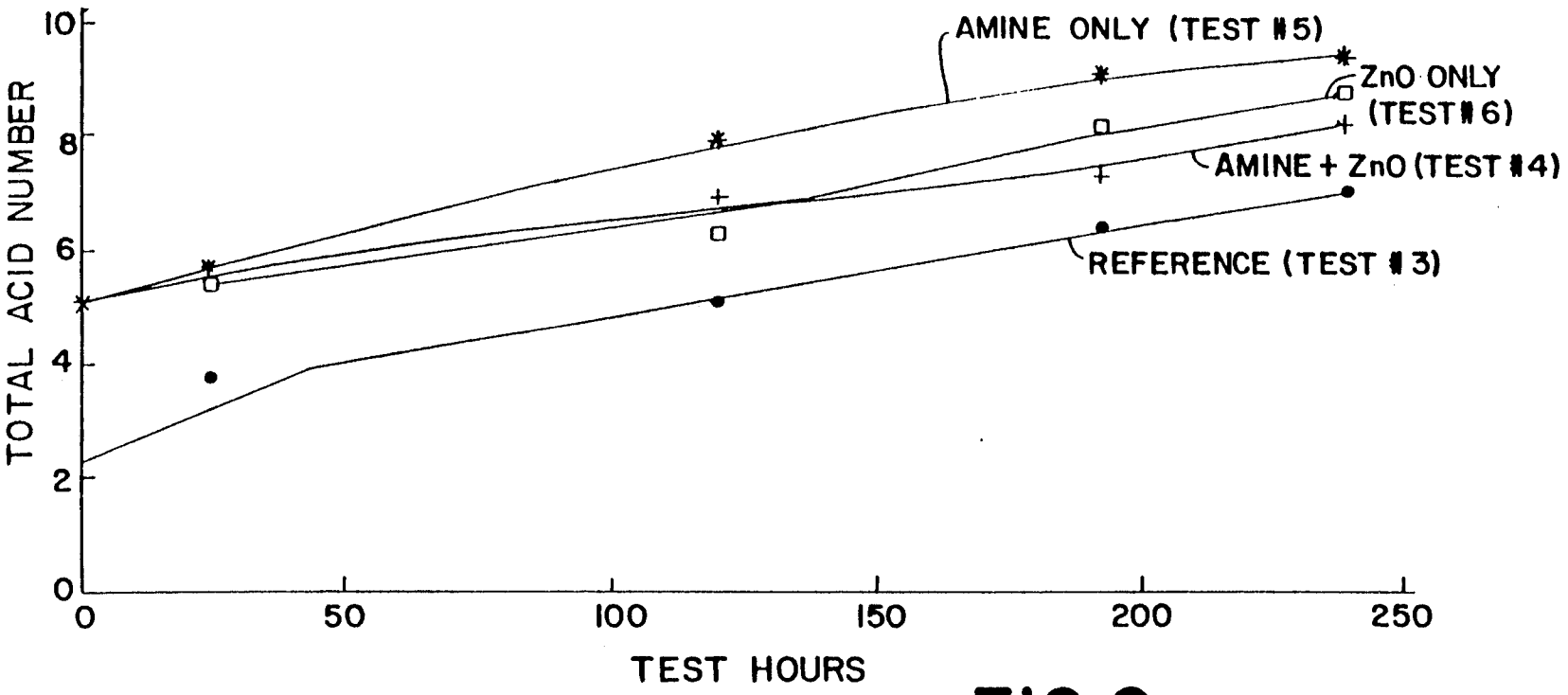
FIG. 2 shows the change in Total Acid Number with time for four lubricating oil blends.

FIG. 2 illustrates that the rate of increase in TAN (as measured by ASTM D664) is less for Test No. 4 oil than for the Test No. 3 oil (with metal detergent), less than for Test No. 5 oil (with only amine in the oil and no ZnO in the filter), and less than for Test No. 6 oil (with no amine or metal detergents in the oil but with ZnO in the filter). This demonstrates control of engine acid corrosion by the present weak base/strong base system.

Figure 3:
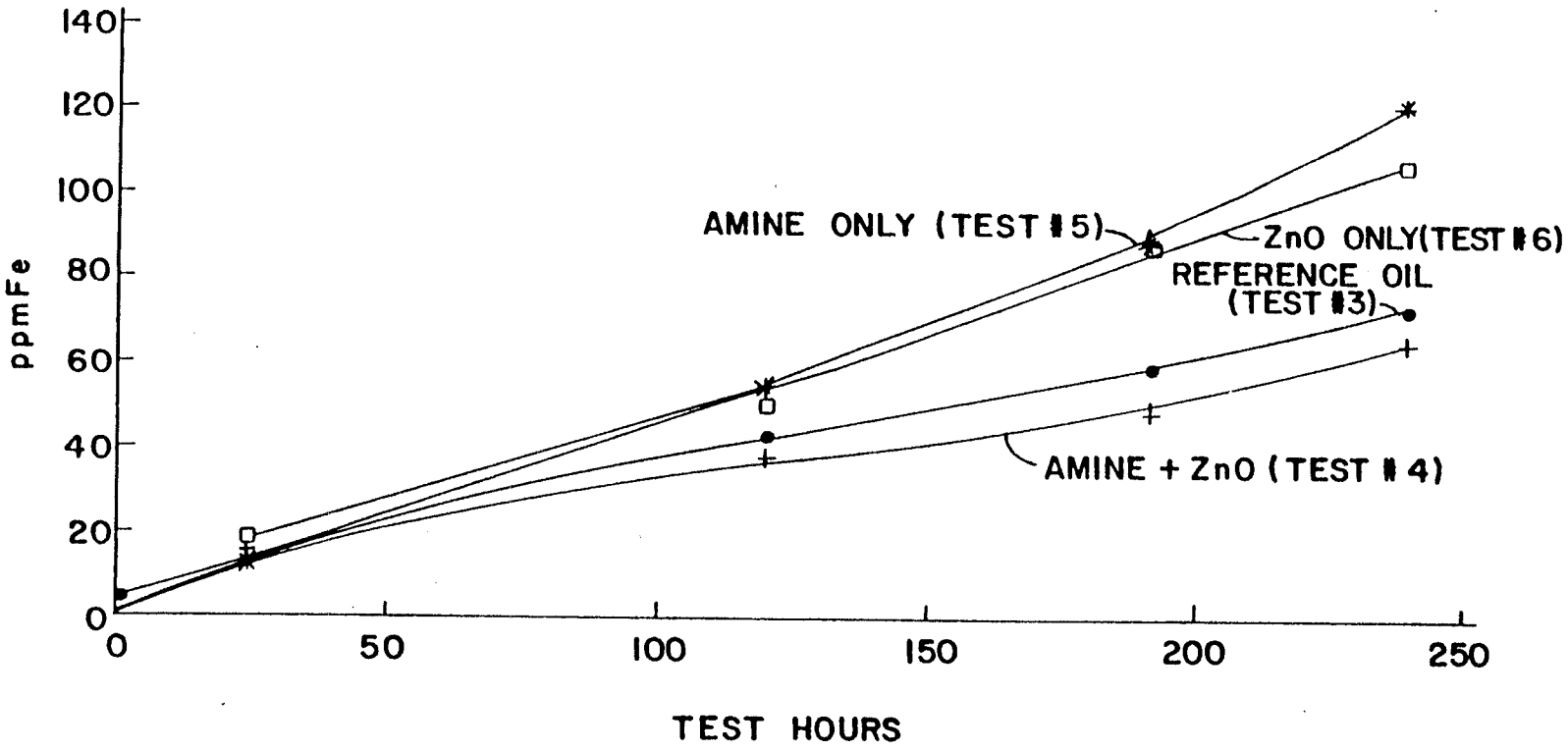
FIG. 3 shows the change in metal wear with time for four lubricating oil blends.

FIG. 3 illustrates that operating the SCOTE engine on Test No. 4 oil produced at least as little soluble Fe (measured by atomic emission spectroscopy) as did the Test No. 3 oil and less than the Test No. 5 oil (with only amine in the oil and no ZnO in the filter) and Test No. 6 oil (with no amine or ash detergent in the oil but with ZnO in the filter). This demonstrates control of engine acid corrosion by the present weak base/strong base system.

Figure 4:
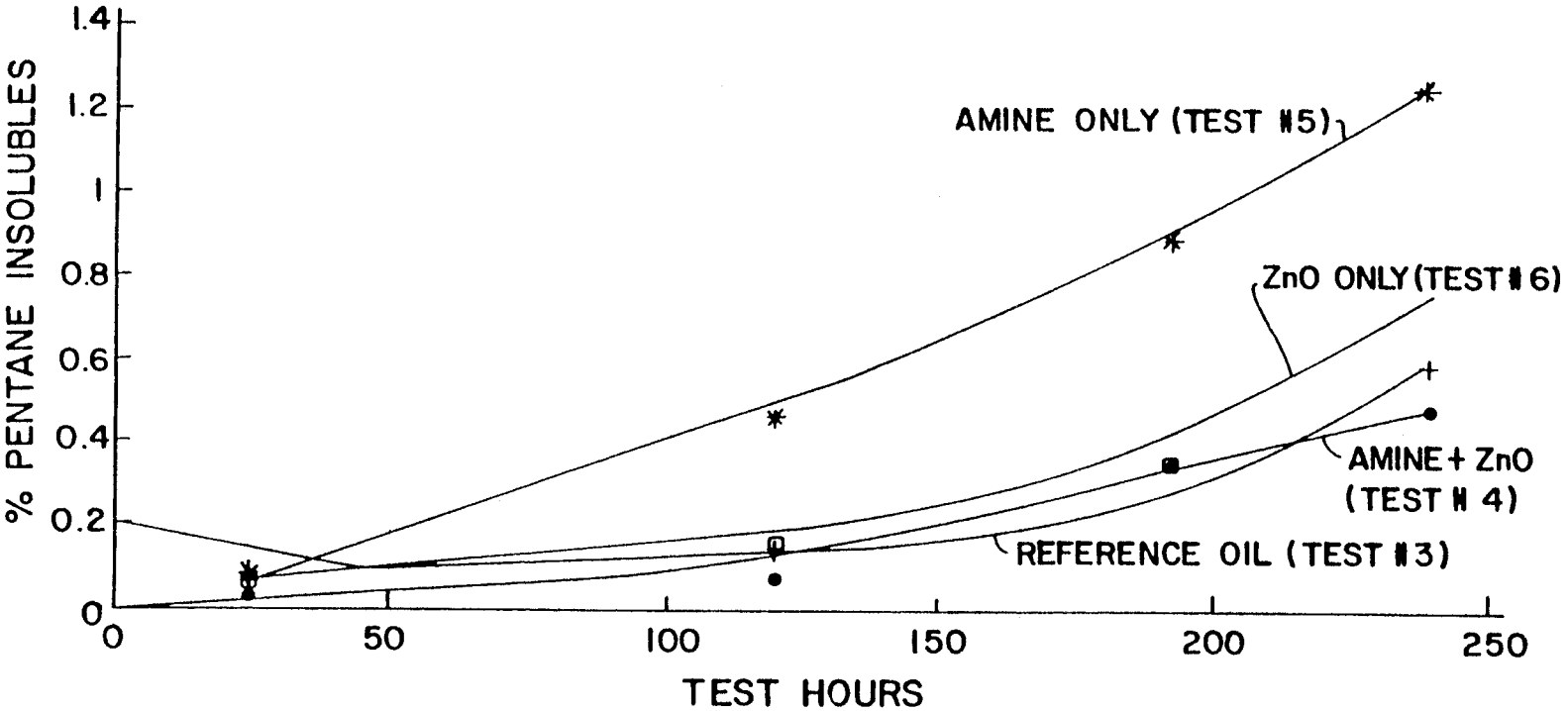
FIG. 4 shows the change in percent pentane insolubles with time for four lubricating oil blends

FIG. 4 illustrates that insolubles (measured by ASTM D893B as pentane insolubles) in the oil were controlled as well by replacing ash detergent with trialkyl amine in conjunction with ZnO in the filter (Test No. 4) as by the ash detergent (test oil 3). Control of insolubles was poorer when either the amine was used without ZnO (Test No. 5) or ZnO was used without the amine (Test No. 6).

EXAMPLE 2

Piston deposits from Tests 3 and 4 of Example 1 were analyzed for sulfur by x-ray. The results obtained are shown in Table 2.

The data in Table 2 show that there is significantly less sulfur on the piston from Test No. 4 (amine +ZnO) than on a piston from Test No. 3 (reference oil).

In addition, no deposits were collected in the engine filter during Test No. 3. However, in Test No. 4, 183.2 g of ZnO pellets were placed in the filter. At the end of Test No. 4, the pellets were removed from the filter and repeatedly washed with heptane to remove oil. After six heptane washes and air drying, the pellets were reweighed and found to have increased in weight by 21%. In addition to the measured weight gain, there were losses of pellets during removal of the pellets from the filter at the completion of the test. Heating a portion of the used pellets to 900° C. to remove organic material resulted in a 30% reduction in weight. Therefore, a significant amount of material (21-30%) was deposited on the pellets during the engine test. A photo acoustic IR (infrared) of the used pellets found strong absorbances at 1200 $cm^{-1}$, which is typical of alkyl sulphates and sulfonates. This confirms that deposits were transferred from the piston to the filter.

What is claimed is:

1. A method for reducing piston deposits in an internal combustion engine lubricated with a lubricating oil containing a soluble weak base and circulating within the lubircation system of the engine which comprises (a) circulating the lubricating oil to the piston ring zone of the engine where fuel combustion acids are introduced into the oil, (b) contacting, at the piston ring zone, the combustion acids with from about 0.01 to about 3.0 wt.% of the weak base such that at least a portion of the acids are neturalized to form a soluble neutral salt containing the weak base and the combustion acids, wherein the weak base has a PKa ranging from about 4 to about 12, (c) circulating the lubricating oil containing the soluble neutral salt to a heterogenous strong base immobilized within the lubrication system of the engine downstream of the piston ring zone, and (d) contacting the soluble neutral salt with the heterogenous strong base, thereby causing at least a portion of the weak base in the salt to be displaced into the lubricating oil and resulting in the formation of a strong base/combustion acid salt which is immobilized with the heterogenous strong base, wherein the heterogenous strong base is part of the oil filter system of the engine.

2. The method of claim 1 wherein the strong base is barium oxide, calcium carbonate, calcium hydroxide, calcium oxide, magnesium carbonate, magnesium hydroxide, magnesium oxide, sodium aluminate, sodium carbonate, sodium hydroxide, zinc oxide, or mixtures thereof.

3. The method of claim 2 wherein the heterogenous strong base is incorporated on a substrate.

4. The method of claim 1 wherein polynuclear aromatic compounds are also removed from the lubrciating oil by contacting the oil with a sorbent located within the lubrication system.

5. The method of claim 4 wherein the sorbent is impregnated with at least one engine lubricating oil additive.

6. The method of claim 5 wherein the lubricating oil additive is an antiwear agent, an antioxidant, a friction modifier, or mixtures thereof.

7. The method of claim 2 wherein the weak base is a dialkyl amine, a trialkyl amine, or mixtures thereof, and the total number of atoms in the alkyl groups is from 12 to 66.

8. The method of claim 7 wherein the weak base is trihexyl amine, trioctadecyl amine, or mixtures thereof.

9. The method of claim 7 wherein the heterogenous strong base is MgO.

10. The method of claim 9 wherein the amount of heterogenous strong base ranges from 1 to about 5 times the equivalent weight of the soluble weak base.

11. The method of claim 3 wherein the substrate is activated carbon.

12. A system for reducing deposits in an internal combustion engine, said deposits resulting from neutralizing acids present in the lubricating oil of said engine, which comprises (a) a lubricating oil that circulates through the lubrication system of the engine, (b) from about 0.01 to about 3.0 wt.% of a soluble weak base having a PKa ranging from about 4 to about 12 that is capable of neutralizing acids present in the oil to form soluble neutral salts containing the weak base and the combustion acids, and (c) a neterogenous strong base immobilized within the lubrication system of the engine, the strong base being capable of displacing the weak base from the soluble neutral salts such that the weak base is returned to the lubricating oil and the resulting strong base/acid salt is immobilized with the heterogenous strong base, wherein the heterogenous strong base is part of the filter sytem of the engine.

13. The system of claim 12 wherein the strong base is barium oxide, calcium carbonate, calcium hydroxide, calcium oxide, magnesium carbonate, magnesium hydroxide, magnesium oxide, sodium aluminate, sodium carbonate, sodium hydroxide, zinc oxide, or mixtures thereof.

14. The system of claim 13 wherein the heterogenous strong base is incorporated on a substrate.

15. The system of claim 14 wherein the substrate is alumina, activated clay, cellulose, cement binder, silica-alumina, activated carbon, or mixtures thereof.

16. The system of claim 12 wherein polynuclear aromatic compounds are also removed from the lubricating oil by contacting the oil with a sorbent located within the lubrication system.

17. The system of claim 16 wherein the sorbent and heterogenous strong base are included within the oil filter system of the engine.

18. The system of claim 15 wherein the substrate is activated carbon.

19. The system of claim 13 wherein the weak base is a dialkyl amine, a trialkylamine, a dialkyl phosphine, a trialkyl phosphine, or mixtures thereof.

20. The system of claim 19 wherein the weak base is a dialkyl amine, a trialkyl amine, or mixtures thereof.

21. The system of claim 20 wherein the weak base comprises a trialkyl amine.

22. The system of claim 21 wherein the trialkyl amine is trihexyl amine, a trioctadecyl amine, or mixtures thereof.

23. The system of claim 22 wherein the heterogenous strong base is MgO.

24. The system of claim 23 wherein the amount of heterogenous strong base therein range from 1 to about 15 times the equivalent weight of the soluble weak base.

25. The system of claim 13 wherein the strong base is MgO.

26. The system of claim 20 wherein the strong base is incorporated on activated carbon.

27. A method for transferring deposits from one location in the lubrication system of an internal combustion engine to another location within the lubrication system, the deposits resulting from neutralizing acids present in the lubricating oil circulating within the lubrication system, which comprises (a) adding from about 0.01 to about 3.0 wt.% of a soluble weak base having a PKa ranging from about 4 to about 12 to the lubricating oil, (b) contacting the weak base with the acids at a first location within the lubrication system, thereby neutralizing the acids and forming a soluble neutral salt containing a weak base and the acids, (c) contacting the soluble neutral salt with a heterogenous strong base immobilized at a second location within the lubrication system, thereby displacing at least a portion of the weak base from the neutral salt into the oil and forming a strong base/acid salt which is immobilized with the heterogenous strong base, wherein the heterogenous strong base is part of the filter system of the engine.

28. The method of claim 27 wherein the strong base is barium oxide, calcium carbonate, calcium hydroxide, calcium oxide, magnesium carbonate, magnesium hydroxide, magnesium oxide, sodium aluminate, sodium carbonate, sodium hydroxide, zinc oxide, or mixtures thereof.

29. The method of claim 28 wherein the heterogenous strong base is incorporated on a substrate.

30. The method of claim 29 wherein the substrate is alumina, activated clay, cellulose, cement binder, silica-alumina, activated carbon, or mixtures thereof.

31. The method of claim 28 wherein the weak base is a dialkyl amine, a trialkylamine, or mixtures thereof.

32. The method of claim 31 wherein the weak base comprises a trialkyl amine.

33. The method of claim 32 wherein the trialkyl amine is trihexyl amine, trioctadecyl amine, or mixtures thereof.

34. The method of claim 33 wherein the heterogenous strong base is MgO.

35. The method of claim 33 wherein the amount of heterogenous strong base ranges from 1 to about 5 times the equivalent weight of the soluble weak base.

* * * * *